US007527504B2

(12) United States Patent
Fujimoto et al.

(10) Patent No.: US 7,527,504 B2
(45) Date of Patent: May 5, 2009

(54) CONNECTOR RECEPTACLE

(75) Inventors: Masaki Fujimoto, Tsu (JP); Tetsurou Kitao, Tsu (JP); Tsuyoshi Yamane, Tsu (JP); Daisuke Sato, Tsu (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/054,905

(22) Filed: Mar. 25, 2008

(65) Prior Publication Data

US 2008/0242135 A1 Oct. 2, 2008

(30) Foreign Application Priority Data

Mar. 27, 2007 (JP) ..... 2007-081292

(51) Int. Cl.
*H01R 12/00* (2006.01)

(52) U.S. Cl. ..... 439/79

(58) Field of Classification Search ..... 439/79, 439/607

See application file for complete search history.

(56) References Cited

U.S. PATENT DOCUMENTS 7,351,105 B2 * 4/2008 Delaney et al. ..... 439/607
7,410,390 B2 * 8/2008 Watanabe et al. ..... 439/607
2004/0192111 A1 * 9/2004 Wu ..... 439/607
2005/0277332 A1 * 12/2005 Chen ..... 439/607
2006/0051988 A1 3/2006 Okura et al.
2006/0154524 A1 * 7/2006 Huang et al. ..... 439/607
2006/0234525 A1 10/2006 Ookura
2007/0049119 A1 3/2007 Fujimoto et al.
2007/0105408 A1 5/2007 Ookura
2007/0161274 A1 7/2007 Tanaka et al.

FOREIGN PATENT DOCUMENTS

JP 2007-59351 3/2007

OTHER PUBLICATIONS

English language Abstract of JP 2007-59351.

* cited by examiner

*Primary Examiner*—Phuong K Dinh
(74) *Attorney, Agent, or Firm*—Greenblum & Bernstein, P.L.C.

(57) ABSTRACT

In a connector receptacle which is mounted on a printed circuit board, a pair of protection protrusions is formed to protrude outward in a insertion direction of a plug from a rear end of a bottom board of a metal shell. A plurality of terminals held on a plug holder is arranged between the protection protrusions in a widthwise direction in a cut portion of the bottom board, so that twisting force acting of the connector receptacle is mainly received by the protection protrusions, and thus, the terminals are protected from peeling off from the printed circuit board. A pair of slits is formed along an extension line of the rear end on the bottom board, so that melted solder for fixing the connector receptacle on the printed circuit board rarely diffused to a lower face of the bottom board.

7 Claims, 5 Drawing Sheets

CONNECTOR RECEPTACLE

BACKGROUND OF THE INVENTION

1. Field of the Invention

The present invention relates to a connector receptacle for a compact connector in compliance with USB (Universal Serial Bus) standard to which a plug is connected, and relates to a structure for mounting the connector receptacle on a printed circuit board.

2. Description of the Related Art

A conventional connector receptacle shown in JP 2007-59351A, for example, is described with reference to FIGS. 5A and 5B. FIG. 5A is a top view and FIG. 5B is a side view of the conventional connector receptacle 100.

The connector receptacle 100 comprises a plurality of posts 109 which is arranged in a widthwise direction of the connector receptacle 100 and held on an insulative post holder 108. The post holder 108 with the posts 109 is enclosed with a metal shell 101. The metal shell 101 has a box-shape with a rectangular section, and two sets of mounting bases 120 are protruded outward from both sidewalls 104 and 105 of the metal shell 101.

Each post 109 has a terminal formed at a rear end thereof. Thus, a plurality of terminals 110 is arranged in the widthwise direction along a rear end 101*a* of the metal shell 101. The terminals 110 are protruded outward from a center portion a rear face 108*a* of the post holder 108 and penetrated trough a rear opening 102 of the metal shell 101. The terminal 110 is bent to have a substantially L-shaped section, as shown in FIG. 5B.

The terminals 110 and the mounting bases 120 are soldered on a printed circuit board (not shown) simultaneously, so that the connector receptacle 100 is mounted on the printed circuit board.

When a plug (not shown) is connected to the connector receptacle 100, forces act on the connector receptacle 100 in diverse directions. Mainly, a force acts on the connector receptacle 100 in an anteroposterior direction due to push in and pull out of the plug to the connector receptacle 100. Simultaneously, a twisting force may act on the connector receptacle 100 when the plug is pushed into or pulled out from the connector receptacle 100.

Since the terminals 110 protruded outward from the rear face 108*a* of the post holder 108 are directly soldered on soldering lands of the printed circuit board with no side protectors, the forces due to push in and pull off of the plug may act on the terminals 110 so as to peel off the terminals 110 from the soldering lands of the printed circuit board. In order to prevent the peeling off of the terminals 110 from the soldering lands of the printed circuit board, it is necessary to increase bonding strength between the mounting bases 120 and the printed circuit board. For increasing the bonding strength between the mounting bases 120 and the printed circuit board, screws should be used together with the soldering of the mounting bases 120, or contacting area of the mounting bases 120 with the printed circuit board should be increased. In the former case, mounting work of the connector receptacle 100 on the printed circuit board becomes complex and burdensome, and manufacturing cost of a product using the connector receptacle becomes expensive. Alternatively, in the latter case, exclusive area of the connector receptacle 100 on the printed circuit board becomes larger because the mounting bases 120 protrudes outward from both sides of the metal shell 101, largely.

SUMMARY OF THE INVENTION

A purpose of the present invention is to provide an improved connector receptacle and a mounting structure of the connector receptacle on a printed circuit board, which enable to reduce an exclusive area of the connector receptacle on the printed circuit board and to increase the bonding strength between the connector receptacle and the printed circuit board, simultaneously.

A connector receptacle in accordance with an aspect of the present invention comprises:

a metal shell having an inner hollow space and a front opening through which a plug is inserted into the inner hollow space;

a post holder that holds a plurality of metal conductors arranged in a widthwise direction of the metal shall which is perpendicular to an insertion direction of the plug, and is fit into the inner hollow space of the metal shell;

a plurality of posts which is arranged in the widthwise direction, wherein each post is formed at a front end portion of the metal conductor and protrudes forward from the post holder in the inner hollow space of the metal shell;

a plurality of terminals which is arranged in the widthwise direction, wherein each terminal is formed at a rear end of the metal conductor opposite to the post, is bent to have a soldered face to be soldered on a soldering land of a printed circuit board, and protrudes rearward from the post holder and protrudes outward from the metal shell; and a pair of protection protrusions formed to protrude outward in the insertion direction of the plug from a rear end of a bottom board of the metal shell at positions so that the terminals arranged in the widthwise direction are located between the protection protrusions.

On the other hand, a mounting structure of a connector receptacle on a printed circuit board in accordance with another aspect of the present invention is characterized by that, the connector receptacle comprises:

a metal shell having an inner hollow space and a front opening through which a plug is inserted into the inner hollow space;

a post holder that holds a plurality of metal conductors arranged in a widthwise direction of the metal shall which is perpendicular to an insertion direction of the plug, and is fit into the inner hollow space of the metal shell;

a plurality of posts which is arranged in the widthwise direction, wherein each post is formed at a front end portion of the metal conductor and protrudes forward from the post holder in the inner hollow space of the metal shell;

a plurality of terminals which is arranged in the widthwise direction, wherein each terminal is formed at a rear end of the metal conductor opposite to the post, is bent to have a soldered face to be soldered on a soldering land of a printed circuit board, and protrudes rearward from the post holder and protrudes outward from the metal shell; and a pair of protection protrusions formed to protrude outward in the insertion direction of the plug from a rear end of a bottom board of the metal shell at positions so that the terminals arranged in the widthwise direction are located between the protection protrusions, and the printed circuit board comprises:

a pair of first soldering lands corresponding to the protection protrusions, wherein each first soldering land has a cut portion formed at a corner facing the rear edge of the bottom board of the metal shell and arrangement of the terminals; and a plurality of second soldering lands corresponding to the terminals and arranged between the first soldering lands.

According to such a configuration, a plurality of the terminals held on the plug holder is arranged between the protection protrusions in a widthwise direction, so that twisting force acting of the connector receptacle is mainly received by the protection protrusions, and thus, the terminals are protected from peeling off from the printed circuit board.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

DETAILED DESCRIPTION OF THE EMBODIMENT

A connector receptacle and a structure for mounting the connector receptacle on a printed circuit board in accordance with an embodiment of the present invention is described with reference to the figures.

Figure 1A:
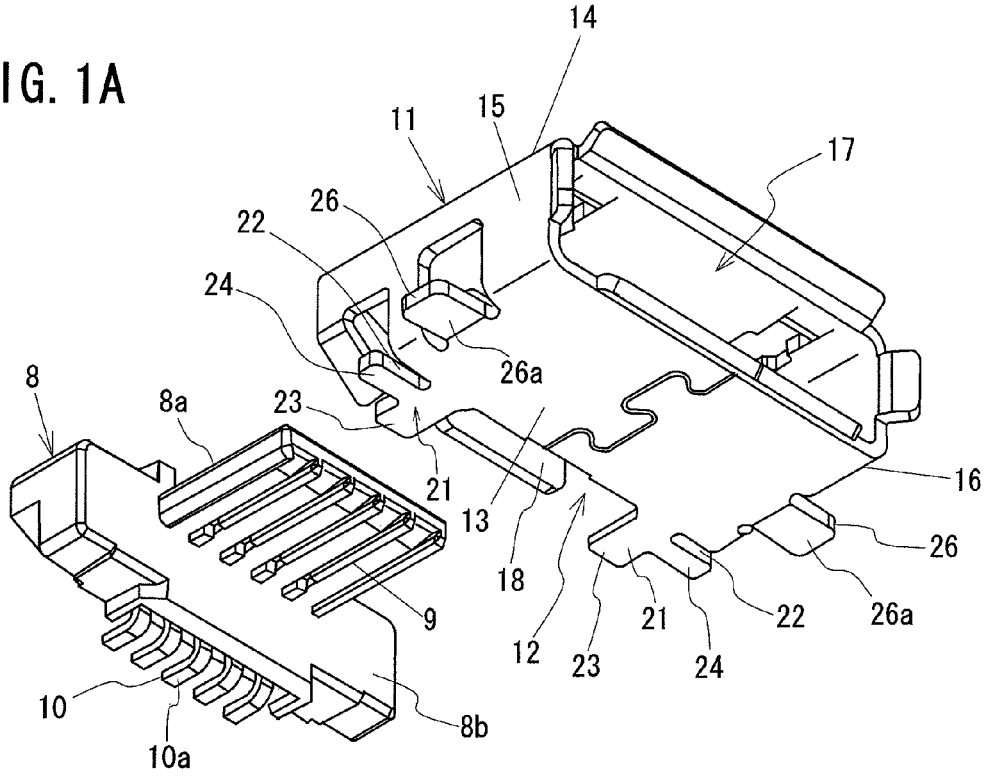
FIG. 1A is an exploded perspective view of a connector receptacle in accordance with an embodiment of the present invention which is observed from front bottom side of thereof.
Figure 1B:
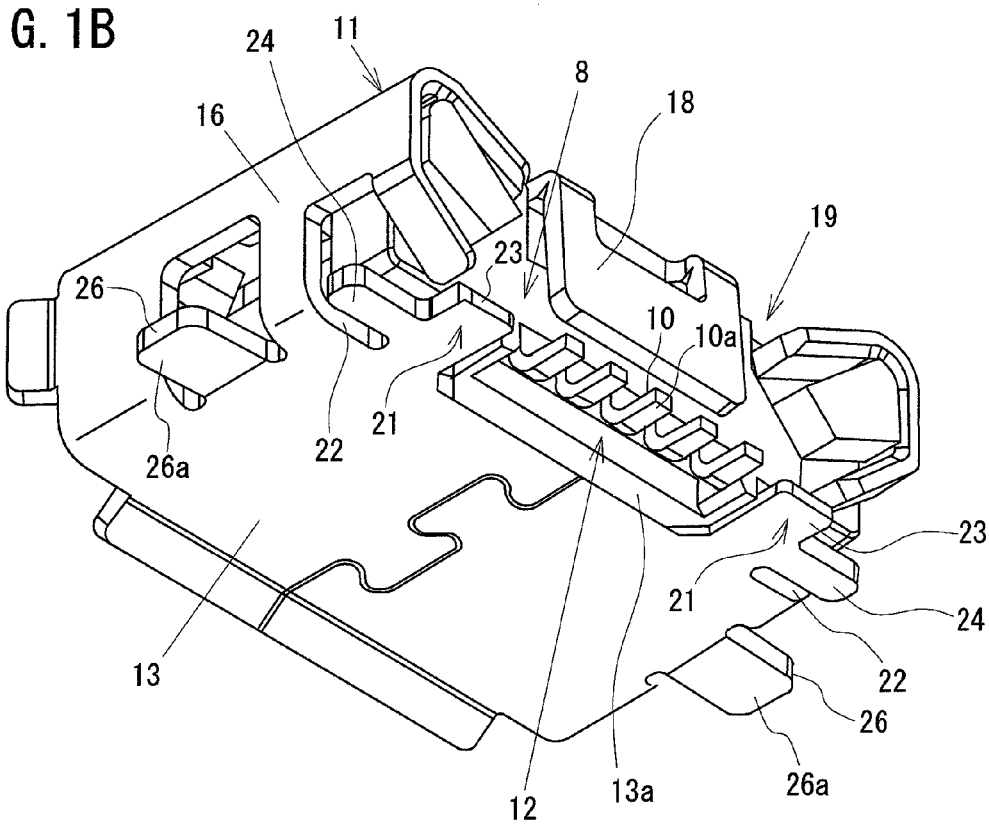
FIG. 1B is a perspective view of the connector receptacle observed from rear bottom side thereof.

As can be seen from FIGS. 1A and 1B, the connector receptacle 1 has a metal shell 11 made of a metal material, and a post holder 8 made of an insulative resin material. The metal shell 11 has a tubular shape configured by a bottom board 13, a ceiling board 14, and side walls 15 and 16, so that the metal shell 11 has a substantially rectangular cross-section and a front opening 17. The bottom board 13 of the metal shell 11 has a cut portion 12 which is communicated with a rear opening 19 of the metal shell 11. The post holder 8 is inserted into an inner hollow space of the metal shell 11 from the communication of the cut portion 12 of the bottom board 13 and the rear opening 19 of the metal shell 11, so that the rear opening 19 of the metal shell 11 is sealed by the post holder 8. A stopper 18 is partially formed to protrude downwardly and to slant slightly from a center portion of a rear edge of the ceiling board 14 of the metal shell 11 so that the stopper 18 contacts an upper edge of a rear face 8*c* of the post holder 8.

Figure 3A:
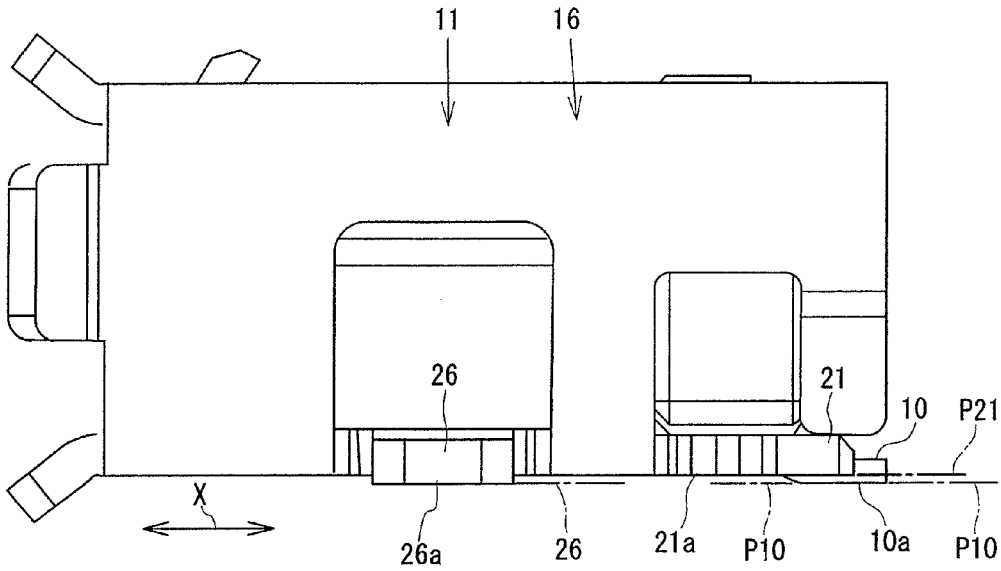
FIG. 3A is a right side view of the connector receptacle.
Figure 3B:
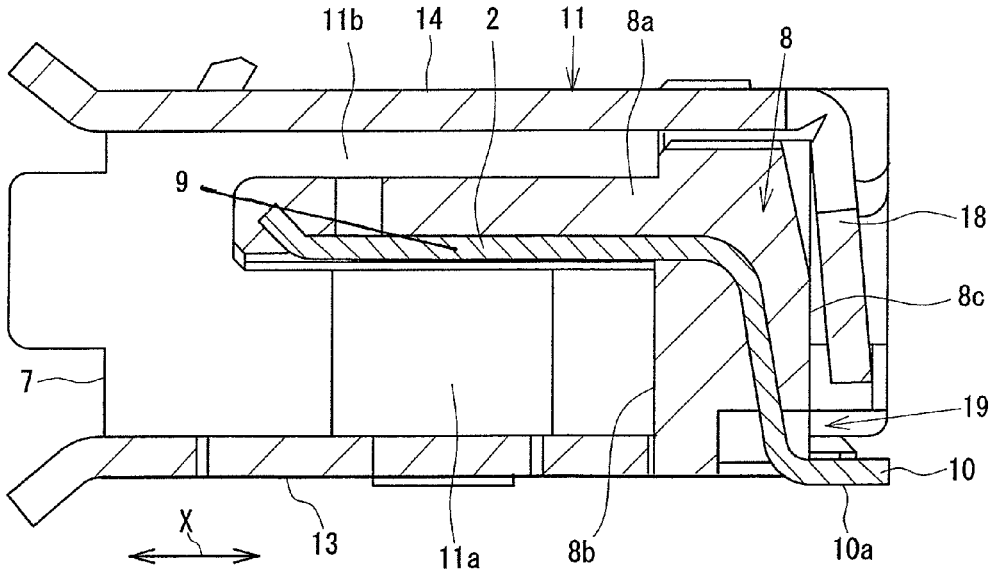
FIG. 3B is a cross-sectional side view of the connector receptacle.

As shown in FIGS. 1A and 3B, the post holder 8 has a post guide wall 8*a* that protrude forward from an upper portion of a front face 8*b* of the post holder 8. The post holder 8 holds a plurality of metal conductors 2 arranged in a widthwise direction Y of the metal shall 11 perpendicular to an insertion direction X of a plug (not shown). The post holder 8 is fit into an inner hollow space of the metal shell 11. A plurality of posts 9, each of which is formed at a front end portion of the metal conductor 2, is held on the post guide wall 8*a* so as to face the bottom board 13, so that the posts 9 are arranged in the widthwise direction Y. A plurality of terminals 10, each of which is formed at a rear end of the metal conductor 2 opposite to the post 9, is arranged in the widthwise direction Y along a rear end 13*a* in the cut portion 12 of the bottom board 13 of the metal shell 11. Each terminal 10, that is, the rear end portion of the metal conductor 2 is bent to have a soldered face 10*a* to be soldered on a soldering land of a printed circuit board. When the post holder 8 is fit into the inner hollow space of the metal shell 11, the terminals 10 are protruded rearward from the post holder 8 and protruded outward from the metal shell 11.

When the post holder 8 is inserted into the inner hollow space of the metal shell 11, spaces 11*a* and 11*b* are formed between the post guide wall 8*a* and the bottom board 13 and the ceiling board 14 of the metal shell 11. When the plug in compliance with the USB standard is connected to the connector receptacle 1, a metal shell of the plug is fit into the spaces 11*a* and 11*b*, and contacts of the plug which are arranged in the metal shell of the plug will contact the posts 9.

A pair of protection protrusions 21 is formed to protrude outward from the rear end 13*a* of the bottom board 13 at both sides of the cut portion 12. The terminals 10 which are protruded from the post holder 8 and arranged in the widthwise direction are located in the cut portion 12 of the metal shell 11. In other words, the protection protrusions 21 serve as side protectors, and thus, the terminals 10 are arranged between the side protectors.

A pair of slits 22 is formed along an extension line of the rear end 13*a* of the bottom board 13 from both sides 13*b* and 13*c* of the bottom board 13 in the widthwise direction Y, so that each protection protrusion 21 has a first protruding portion 23 protruding outward from the rear end 13*a* of the bottom board 13 in the insertion direction X of the plug and a second protruding portion 24 protruding outward from the first protruding portion 23 along the slit 22 in the widthwise direction Y.

Figure 2A:
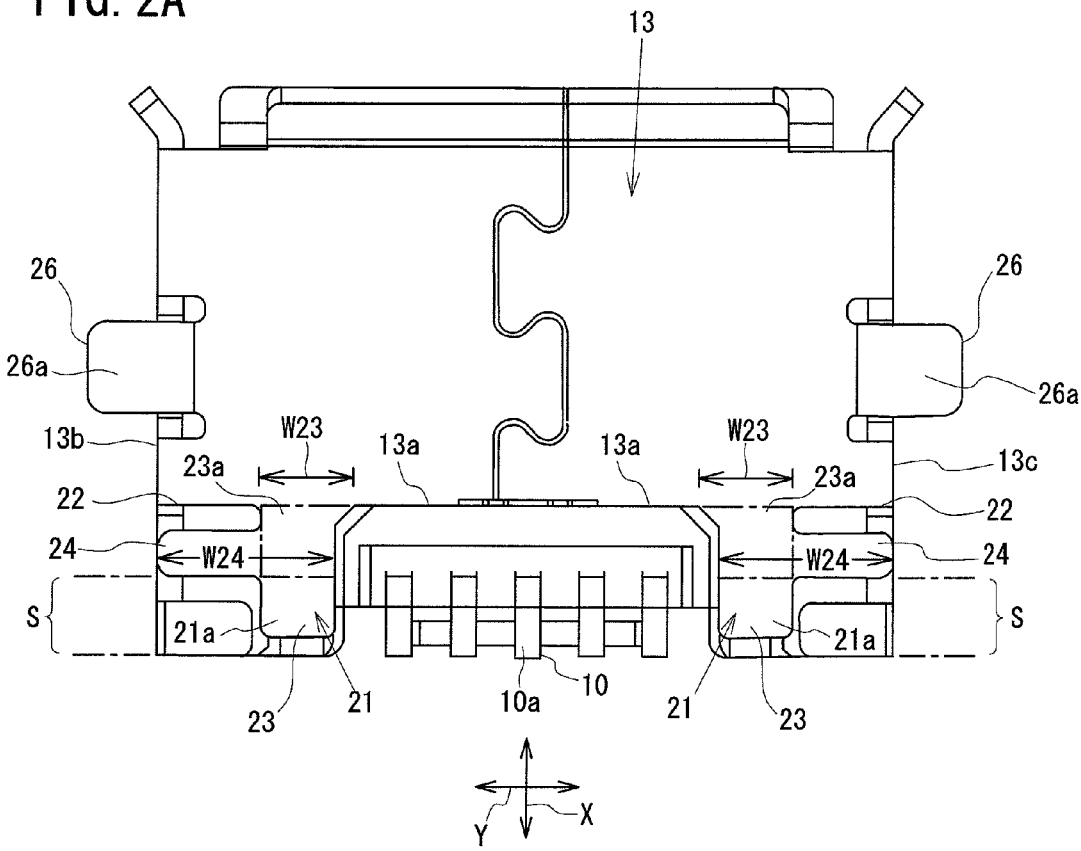
FIG. 2A is a bottom view of the connector receptacle.

As shown in FIG. 2A, a root portion 23*a* of the first protruding portion 23 of the protection protrusion 21 has a width W23 in the widthwise direction Y on an extension line of the rear end 13*a* of the bottom board 13. The width W23 is selected to be smaller than the largest width W24 at the second protruding portion 24 of the protection protrusions 21 in the widthwise direction Y. In addition, a pair of mounting bases 26 is protruded outward from center portions of both sides 13*b* and 13*c* of the bottom board 13 in the widthwise direction Y.

Figure 2B:
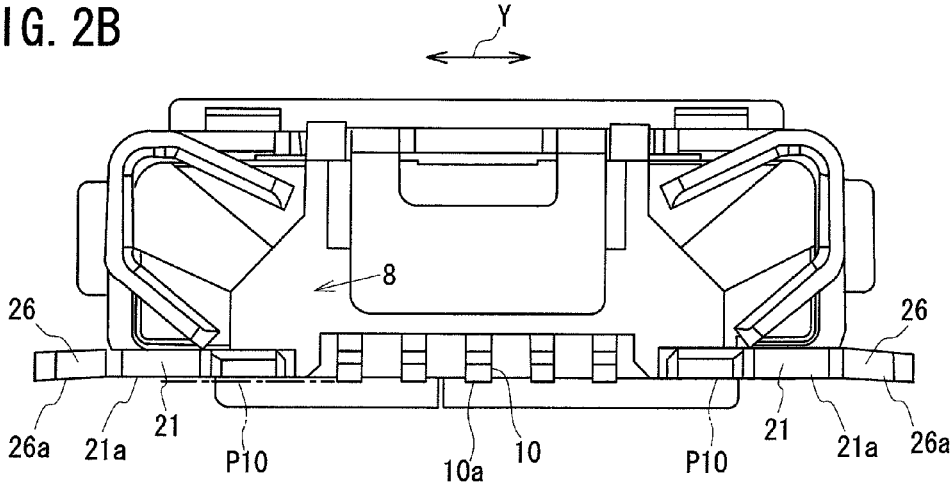
FIG. 2B is a rear view of the connector receptacle.

As shown in FIGS. 2B and 3A, a lower face 10*a* of each terminal 10 serving as a soldered face is located on a flat plane P10. On the other hand, a lower face 21*a* of the protection protrusion 21 serving as a soldered face is located on a flat plane P21 which is a little above the lower face 10*a* of the terminal 10. The mounting base 26 is slanted slightly downward so that a top end of a lower face 26*a* of the mounting base 26 serving as a soldered face is located on a plane P26 a little below the flat plane P21. Elevations of these planes P10, P21 and P26 are selected so that the protection protrusions 21 and the mounting bases 26 can be soldered on soldering lands simultaneously when the terminals 10 are soldered on soldering lands of the printed circuit board.

Figure 4A:
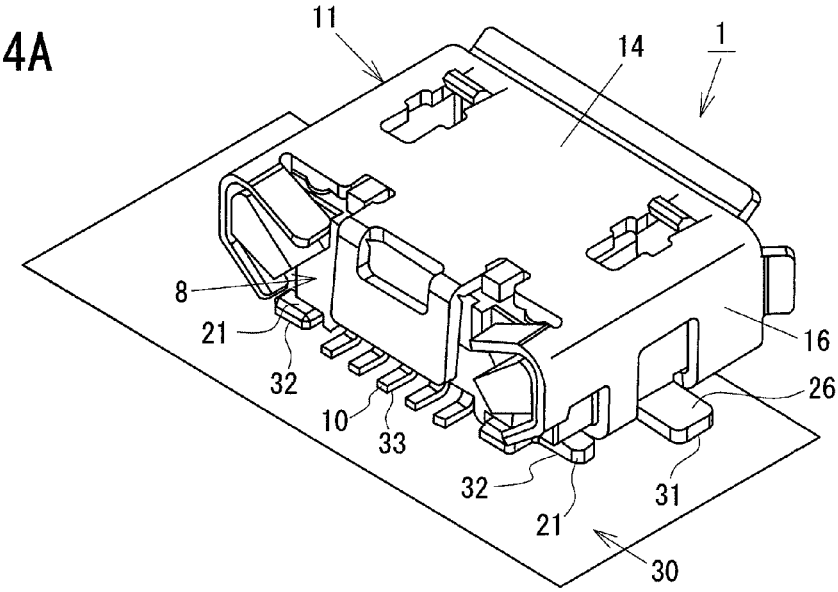
FIG. 4A is a perspective view showing the connector receptacle mounted on a printed circuit board.
Figure 4B:
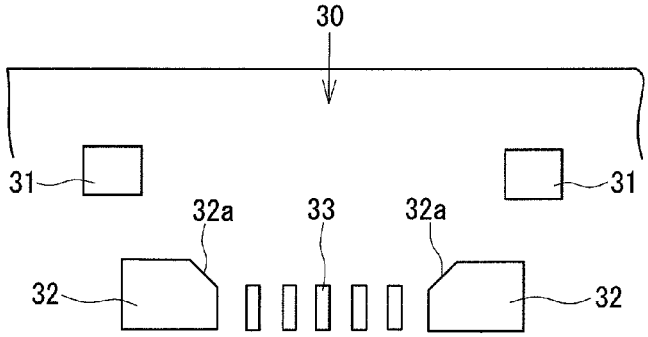
FIG. 4B is a plane view showing a pattern of soldering lands on the printed circuit board.
Figure 4C:
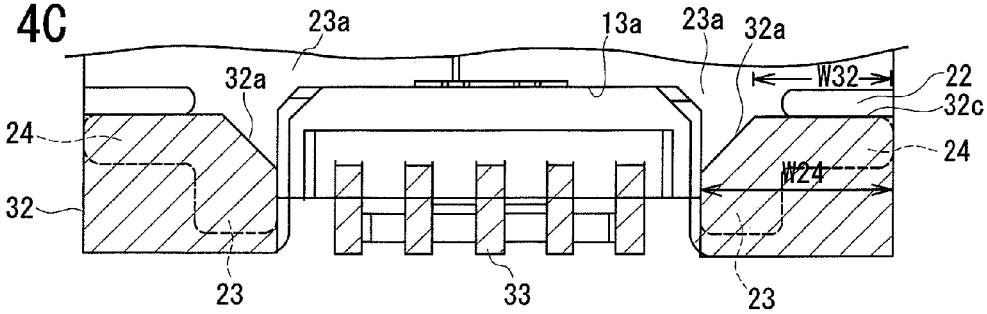
FIG. 4C is a fluoroscopic bottom view of an example of the connector receptacle mounted on a printed circuit board.
Figure 4D:
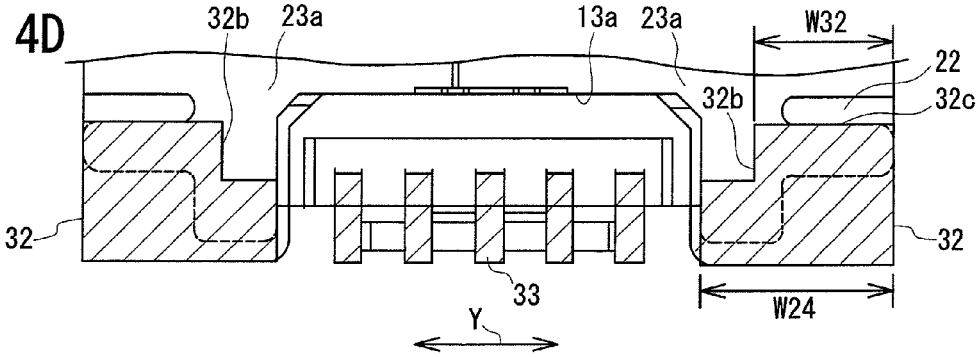
FIG. 4D is a fluoroscopic bottom view of another example of the connector receptacle mounted on a printed circuit board.
Figure 5A:
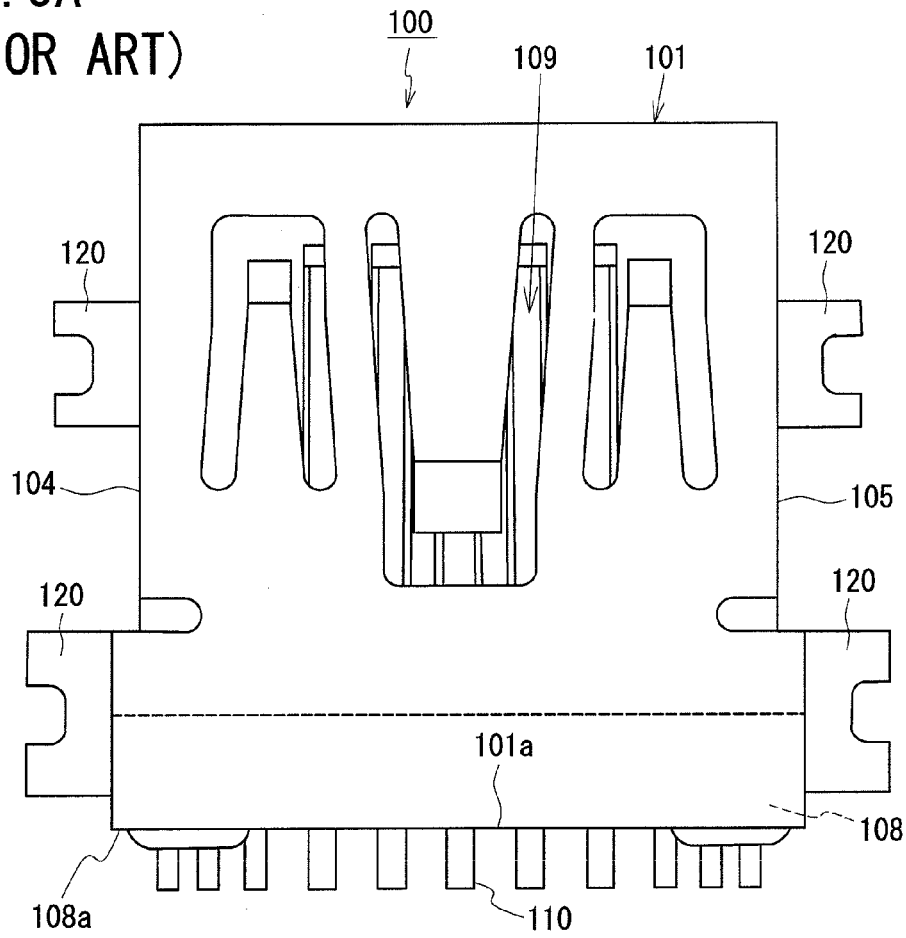
FIG. 5A (PRIOR ART)
FIG. 5A is a top view of a conventional connector receptacle.
Figure 5B:
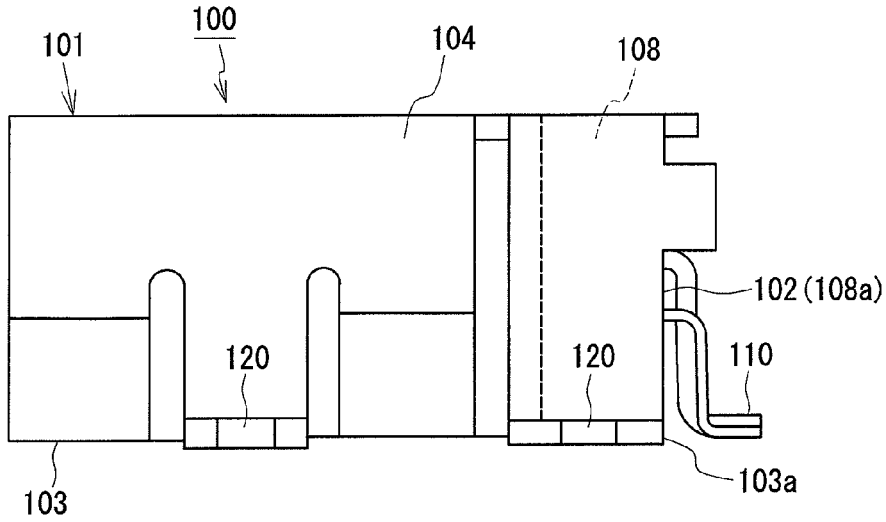
FIG. 5B (PRIOR ART)
FIG. 5B is a side view of the conventional connector receptacle.

FIG. 4B shows an example of a pattern of soldering lands on a printed circuit board 30. A pair of third soldering lands 31 corresponds to the mounting bases 26, and a pair of first soldering lands 32 corresponds to the protection protrusions 21. A plurality of second soldering lands 33 arranged between the first soldering lands 32 corresponds to the terminals 10. FIGS. 4C and 4D respectively show relations between the protection protrusions 21 and the first soldering lands 32 when the connector receptacle 1 is mounted on the printed circuit board 30 as shown in FIG. 4A. In the example shown in FIG. 4C, a triangular shaped cut portion 32*a* is formed on the first soldering land 32. In the example shown in FIG. 4D, a rectangular shaped cut portion 32*b* is formed on the first soldering land 32.

As shown in FIG. 4C or 4D, the first soldering land 32 has a dimension substantially equal to the largest width W24 of the protection protrusion 21 in the widthwise direction Y, and a dimension substantially equal to a dimension of the lower face 10*a* serving as the soldered face of the terminal 10 in the insertion direction. The cut portion 32*a* or 32*b* is formed at a corner facing the rear edge 13*a* of the bottom board 13 and arrangement of the terminals 10. Since the cut portion 32*a* or 32*b* is formed on the first soldering land 32, a dimension W32 of the soldering land 32 in the widthwise direction Y on the edge 32*c* which faces the extension line of the rear end 13*a* of the bottom board 13 of the metal shell 11 becomes narrower than the largest width W24 of the protection protrusions 21. When the connector receptacle 1 is mounted on the printed circuit board 30, since the slit 22 is formed on the extension line of the rear end 13*a* of the bottom board 13, a part of the first protruding portion 23 and the second protruding portion 24 of the protection protrusion 21 are soldered on the soldering land 32. In addition, edge or edges of the cut portion 32*a* or 32*b* of the soldering land 32 is or are distant from the extension line of the rear end 13*a* of the bottom board 13 because of the existence of the cut portion 32*a* or 32*b*. Thus, melted solder, which fixes the protection protrusion 21 of the metal shell 11 on the soldering land 32, rarely diffuses to the lower face of the bottom board 13. The melted solder overflowed from a gap between the protection protrusion 21 and the soldering land 32 is accumulated in the cut portion 32*a* or 32*b*. Consequently, a quantity of solder which is necessary to mount the protection protrusion 21 of the metal shell 11 on the printed circuit board 30 is ensured, and thus, the bonding strength of the metal shell 11 for the printed circuit board 30 can be increased.

As shown in FIG. 2A, since the terminals 10 are arranged between the protection protrusions 21 in a region "S", a force in an anteroposterior direction of the connector receptacle 1 due to push in and pull out of a plug acts on the terminals 10 and the protection protrusions 21. Hereupon, a contacting area between the protection protrusions 21 and the printed circuit board 30 is much larger than that between the terminals 10 and the printed circuit board 30, so that the force in the anteroposterior direction mainly acts on the protection protrusions 21. Consequently, the terminals 10 are protected from peeling off from the printed circuit board 30 due to the force acting on the connector receptacle 1 in the anteroposterior direction.

On the other hand, when a twisting force acts on the connector receptacle 1, a moment, which rotates the metal shell 1, is generated in a plane perpendicular to the surface of the printed circuit board 30. The moment, however, acts on one of the protection protrusions 21 to rotate the metal shell 11 with respect to the other protection protrusion 21 which serves as a fulcrum. Hereupon, the lower faces 10*a* serving as the soldered faces of the terminals 10 are located below the lower faces 21*a* serving as the soldered faces of the protection protrusions 21, as shown in FIG. 3A. Even when one of the protection protrusions 21 is pulled up elastically by the above mentioned twisting force, the terminals 10 are still fixed on the soldering lands 33 on the printed circuit board 30 due to the difference of elevation between the lower faces 10*a* of the terminals 10 and the lower faces 21*a* of the protection protrusions 21. Consequently, the terminals 10 are protected from peeling off from the printed circuit board 30 due to the twisting force acting on the connector receptacle 1.

In addition, the protection protrusions 21 serve as mounting bases of the metal shell 11, so that the metal shell 11 is soldered on the printed circuit board 30 at four points of two protection protrusions 21 and two mounting bases 26. Thus, the bonding strength of the metal shell 11 of the connector receptacle 1 on the printed circuit board 30 in this embodiment can be ensured substantially the same value as that of the conventional connector receptacle as mentioned above. The terminals 10, however, are protected by the protection protrusions 21, so that it is no need to increase the bonding strength of the metal shell 11 due to the protection protrusions 21 and the mounting bases 26. In other words, it is possible to reduce the contacting areas of the protection protrusions 21 and the mounting bases 26 for the printed circuit board 30. Furthermore, only two mounting bases 26 are protruded outward in the widthwise direction Y from the metal shell 11, so that it is possible to decrease the exclusive areas of the connector receptacle 1 on the printed circuit board 30.

The present invention is not limited to the configuration of the above mentioned embodiment. In the above mentioned embodiment, the second protruding portions 24 of the protection protrusions 21 are formed out of the region "S". It, however, is possible to form a part of or whole of the second protruding portions 24 of the protection protrusions 21 in the region "S". In addition, it is possible that the root portion 23*a* of the first protruding portion 23 is located in the region "S". Furthermore, the shapes of the protection protrusions 21 are not limited to the above mentioned shapes.

In addition, the flat plane P10 on which the lower faces 10*a* of the terminals 10 are located is disposed a little below the flat plane P21 on which the lower faces 21*a* of the protection protrusions 21 are place, and the plane P26 on which the top ends of the lower faces 26*a* of the mounting bases 26 are located is disposed a little below the flat plane P21. It, however, is possible to place these planes P10, P21 and P26 on the same plane.

This application is based on Japanese patent application 2007-81292 filed Mar. 27, 2007 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A connector receptacles, comprising:

a metal shell having an inner hollow space and a front opening through which a plug is inserted into the inner hollow space;

a post holder that holds a plurality of metal conductors arranged in a widthwise direction of the metal shall which is perpendicular to an insertion direction of the plug, and is fit into the inner hollow space of the metal shell;

a plurality of posts which is arranged in the widthwise direction, wherein each post is formed at a front end portion of the metal conductor and protrudes forward from the post holder in the inner hollow space of the metal shell;

a plurality of terminals which is arranged in the widthwise direction, wherein each terminal is formed at a rear end of the metal conductor opposite to the post, is bent to have a soldered face to be soldered on a soldering land of a printed circuit board, and protrudes rearward from the post holder and protrudes outward from the metal shell;

a pair of protection protrusions formed to protrude outward in the insertion direction of the plug from a rear end of a bottom board of the metal shell at positions so that the terminals arranged in the widthwise direction are located between the protection protrusions; and a pair of slits formed along an extension line of the rear end of the bottom board from both sides of the bottom board in the widthwise direction, wherein each protection protrusion has a first protruding portion protruding outward from the rear end of the bottom board in the insertion direction and a second protruding portion protruding outward from the first protruding portion along the slit in the widthwise direction.

2. The connector receptacle in accordance with claim 1, wherein a lower face of the protection protrusion is located above a lower face of each terminal.

3. A mounting structure of a connector receptacle on a printed circuit board, the connector receptacle comprising:

a metal shell having an inner hollow space and a front opening through which a plug is inserted into the inner hollow space;

a post holder that holds a plurality of metal conductors arranged in a widthwise direction of the metal shall which is perpendicular to an insertion direction of the plug, and is fit into the inner hollow space of the metal shell;

a plurality of posts which is arranged in the widthwise direction, wherein each post is formed at a front end portion of the metal conductor and protrudes forward from the post holder in the inner hollow space of the metal shell;

a plurality of terminals which is arranged in the widthwise direction, wherein each terminal is formed at a rear end of the metal conductor opposite to the post, is bent to have a soldered face to be soldered on a soldering land of a printed circuit board, and protrudes rearward from the post holder and protrudes outward from the metal shell; and a pair of protection protrusions formed to protrude outward in the insertion direction of the plug from a rear end of a bottom board of the metal shell at positions so that the terminals arranged in the widthwise direction are located between the protection protrusions, and the printed circuit board comprises:

a pair of first soldering lands corresponding to the protection protrusions, wherein each first soldering land has a cut portion formed at a corner facing the rear edge of the bottom board of the metal shell and arrangement of the terminals; and a plurality of second soldering lands corresponding to the terminals and arranged between the first soldering lands.

4. The mounting structure in accordance with claim 3, wherein each of the first soldering land has a dimension substantially equal to a largest width of the protection protruding in the widthwise direction and a dimension substantially equal to a dimension of a lower face serving as a soldered face of the terminal in the insertion direction.

5. The mounting structure in accordance with claim 3, wherein a pair of slits is formed along an extension line of the rear end of the bottom board from both sides of the bottom board in the widthwise direction.

6. The mounting structure in accordance with claim 5, wherein each protection protrusion has a first protruding portion protruding outward from the rear end of the bottom board in the insertion direction and a second protruding portion protruding outward from the first protruding portion along the slit in the widthwise direction.

7. The connector receptacle in accordance with claim 3, wherein a lower face of the protection protrusion is located above a lower face of each terminal.

* * * * *